US007074531B2

(12) United States Patent
Fukushima et al.

(10) Patent No.: US 7,074,531 B2
(45) Date of Patent: Jul. 11, 2006

(54) ELECTROPHOTOGRAPHIC PHOTORECEPTOR

(75) Inventors: Kotaro Fukushima, Kawanishi (JP); Mikio Kakui, Nara (JP); Koichi Toriyama, Yao (JP); Hisayuki Utsumi, Yamatokoriyama (JP)

(73) Assignee: Sharp Kabushiki Kaisha, Osaka (JP)

( * ) Notice: Subject to any disclaimer, the term of this patent is extended or adjusted under 35 U.S.C. 154(b) by 162 days.

(21) Appl. No.: 10/740,524

(22) Filed: Dec. 22, 2003

(65) Prior Publication Data

US 2004/0142258 A1 Jul. 22, 2004

(30) Foreign Application Priority Data

Dec. 20, 2002 (JP) ..... P2002-370961

(51) Int. Cl.
*G03G 5/147* (2006.01)

(52) U.S. Cl. ..... 430/56; 430/57.1; 399/159

(58) Field of Classification Search ..... 430/56, 430/57.1; 399/159
See application file for complete search history.

(56) References Cited

U.S. PATENT DOCUMENTS 4,724,194 A 2/1988 Shirai et al.
6,171,742 B1 1/2001 Kawada et al.
2001/0051308 A1* 12/2001 Kawamura et al. ..... 430/66

FOREIGN PATENT DOCUMENTS

JP 60-22131 A 2/1985
JP 11-311875 A 11/1999

OTHER PUBLICATIONS

Fowkes, "Extension of Fowkes's Formula Evaluation of Surface Tension of Polymeric Solid", vol. 8, No. 3, 1972, pp. 131-141 and partial English translation thereof.

* cited by examiner

*Primary Examiner*—Mark A. Chapman
(74) *Attorney, Agent, or Firm*—Nixon & Vanderhye P.C.

(57) ABSTRACT

In an electrophotographic photoreceptor including a conductive substrate and a photoreceptive layer formed on the conductive substrate wherein the photoreceptive layer charged uniformly is exposed to light corresponding to an image information to form an electrostatic latent image, the surface free energy (γ) is determined to be at least 20 mN/m and at most 35 mN/m. The determination of γ on the surface of the photoreceptor 1 in the appropriate range makes it possible to suppress excessive adhesion of a toner to the surface of the photoreceptor, to suppress adhesion of foreign matters such as a paper powder and to make easy the separation thereof from the surface, which results in improving the cleanability of the photoreceptor. Since the image is formed with the photoreceptor 1 having always the clean surface, the damage or the decrease in image quality does not occur over a long period of time.

12 Claims, 5 Drawing Sheets

ELECTROPHOTOGRAPHIC PHOTORECEPTOR

BACKGROUND OF THE INVENTION

1. Field of the Invention

The present invention relates to an electrophotographic photoreceptor which is used in, for example, an electrophotographic image forming apparatus of a copying machine or the like.

2. Description of the Related Art

An electrophotographic image forming apparatus has found wide acceptance in not only a copying machine but also a printer, an output device of a computer which has been increasingly demanded in recent years. In the electrophotographic image forming apparatus, a photoreceptive layer of an electrophotographic photoreceptor installed in the apparatus is uniformly charged with a charging unit, exposed to, for example, a laser beam corresponding to an image information, and a fine-grain developer called a toner is supplied to an electrostatic latent image formed by the exposure from a developing unit to form a toner image.

The toner image formed by adhering the toner as a component of the developer to the surface of the electrophotographic photoreceptor is transferred onto a transfer member such as a recording paper with a transfer unit. However, the toner on the surface of the electrophotographic photoreceptor is not completely transferred onto a recording paper, but a part thereof remains on the surface of the electrophotographic photoreceptor. Further, a paper powder of the recording paper contacted with the electrophotographic photoreceptor in the development might remain on the electrophotographic photoreceptor while being adhered thereto.

Since the remaining toner and the adhered paper powder on the surface of the photographic photoreceptor have an adverse effect on a quality of an image formed, they are removed with a cleaner. Moreover, in recent years, a cleanerless technique has been advanced, and the remaining toner is removed by such a development/cleaning system that it is recovered by a cleaning function imparted to a developing unit without providing an independent cleaning unit. Since charging, exposure, development, transfer, cleaning and electricity removal are repeatedly performed in the electrophotographic photoreceptor, durability to electrical and mechanical outer forces is required. Specifically, the electrophotographic photoreceptor requires durability to abrasion or damage caused by rubbing the surface of the electrophotographic photoreceptor, deterioration of a surface layer by adhesion of active substances such as ozone and Nox generated in charging with a charging unit, and the like.

In order to realize cost reduction and maintenance-free condition of the electrophotographic image forming apparatus, it is important that the electrophotographic photoreceptor has satisfactory durability and can be operated stably for a long period of time. One of factors that influence the durability and the long-term stability of the operation is surface cleanability, namely, ease of surface cleaning which is related with the surface condition of the electrophotographic photoreceptor.

The cleaning of the electrophotographic photoreceptor means that a force exceeding adhesion between the surface of the electrophotographic photoreceptor and the remaining toner or paper powder adhered is exerted on the remaining toner or paper powder to remove the adherent matter from the surface of the electrophotographic photoreceptor. Accordingly, the lower the wettability of the surface of the electrophotographic photoreceptor, the easier the cleaning. The wettability, namely, the adhesion of the surface of the electrophotographic photoreceptor can be expressed using a surface free energy (which has the same meaning as a surface tension) as an index.

The surface free energy ($\gamma$) is a phenomenon which an intermolecular force, a force acting between molecules constituting a substance, causes on the outermost surface.

A toner that remains on the surface of the electrophotographic photoreceptor by adhesion or fusion without being transferred onto a transfer member is spread on the surface of the electrophotographic photoreceptor in the form of a film while steps from charging to cleaning are repeated. This phenomenon corresponds to "adhesion wettability" in the wettability. Further, a phenomenon in which a paper powder, a rosin, talc or the like is adhered to the surface of the photographic photoreceptor and the contact area with the electrophotographic photoreceptor is then increased to provide strong wettability also corresponds to "adhesion wettability".

FIG. 6 is a side view showing a state of adhesion wettability. In the adhesion wettability shown in FIG. 6, the relation between the wettability and the surface free energy ($\gamma$) is represented by Young's formula (1).

$$\gamma_1=\gamma_2\cdot\cos\theta+\gamma_{12} \quad (1)$$

wherein $\gamma_1$: surface free energy on a surface of product 1

$\gamma_2$: surface free energy on a surface of product 2

$\gamma_{12}$: interface free energy of products 1 and 2

$\theta$: contact angle of product 2 to product 1

In formula (1), reduction in wettability of product 2 to product 1 which means that $\theta$ is increased for less wetting is attained by increasing the interface free energy $Y_{12}$ related with a wetting work of the electrophotographic photoreceptor and the foreign matters and decreasing the surface free energies $\gamma_1$ and $\gamma_2$.

When adhesion of foreign matters, water vapor and the like to the surface of the electrophotographic photoreceptor is considered in formula (1), product 1 corresponds to the electrophotographic photoreceptor and product 2 to foreign matters respectively. Accordingly, when the electrophotographic photoreceptor is actually cleaned, the wettability on the right side of formula (1), namely, the adhered condition of the toner, paper powder and the like as foreign matters to the electrophotographic photoreceptor can be controlled by controlling the surface free energy $\gamma_1$ of the electrophotographic photoreceptor.

In the prior technique that defines a surface condition of an electrophotographic photoreceptor, a contact angle with pure water is used (refer to, for example, Japanese Unexamined Patent Publication JP-A 60-22131 (1985)). However, in regard to wetting of a solid and a liquid, the contact angle $\theta$ can be measured as shown in FIG. 6, but in case of a solid and a solid such as an electrophotographic photoreceptor and a toner or a paper powder, the contact angle $\theta$ cannot be measured. Accordingly, the foregoing prior technique can be applied to wettability between a surface of an electrophotographic photoreceptor and pure water, but a relation between wettability and cleanability of a solid such as a toner constituting a developer or a paper powder cannot be explained satisfactorily.

With respect to an interface free energy between a solid and a solid which is deemed necessary for evaluation of a wettability between a solid and a solid, the Forkes 's theory stating a non-polar intermolecular force is considered to be further extended to a component formed by a polar or hydrogen-bonding intermolecular force (refer to Kitazaki T., Hata T., et al.; "Extension of Forkes's Formula and Evaluation of Surface Tension of Polymeric Solid", Nippon Secchaku Kyokaishi, Nippon Secchaku Kyokai, 1972, vol. 8, No. 3, pp. 131–141). According to this extended Forkes's theory, the surface free energy of each product is found from 2 to 3 components. The surface free energy in the adhesion wettability corresponding to the adhesion of the toner or the paper powder to the surface of the electrophotographic photoreceptor can be found from 3 components.

The surface free energy between solid products is described below. In the extended Forkes's theory, an addition rule of the surface free energy represented by formula (2) is assumed to be established.

$$\gamma=\gamma^d+\gamma^p+\gamma^h \quad (2)$$

wherein $\gamma^d$: dispersion component (non-polar wettability)

$\gamma^p$: dipolar component (polar wettability)

$\gamma^h$: hydrogen-bonding component (hydrogen-bonding wettability)

When the addition rule of formula (2) is applied to the Forkes 's theory, the interface free energy $Y_{12}$ between product 1 and product 2 which are both solids is obtained as shown in formula (3).

$$\gamma_{12}=\gamma_1+\gamma_2-\{2\sqrt{(\gamma_1^d\cdot\gamma_2^d)}+2\sqrt{(\gamma_1^p\cdot\gamma_2^p)}+2\sqrt{(\gamma_1^h\cdot\gamma_2^h)}\} \quad (3)$$

wherein $\gamma_1$: surface free energy of product 1

$\gamma_2$: surface free energy of product 2

$\gamma_1^d$, $\gamma_2^d$: dispersion components of product 1 and product 2

$\gamma_1^p$, $\gamma_2^p$: dipolar components of product 1 and product 2

$\gamma_1^h$, $\gamma_2^h$: hydrogen-bonding components of product 1 and product 2

The surface free energies ($\gamma^d$, $\gamma^p$, $\gamma^h$) of the components in the solid products to be measured as represented by formula (2) can be calculated by using known reagents and measuring adhesion with the reagents. Accordingly, with respect to product 1 and product 2 , it is possible that the surface free energies of the components are found and the interface free energy of product 1 and product 2 can be found from the surface free energies of the components using formula (3).

On the basis of the concept of the solid-solid interface free energy found in this manner, another prior technique controls wettability of a surface of an electrophotographic photoreceptor and a toner or the like using a surface free energy of the electrophotographic photoreceptor as an index (refer to Japanese Unexamined Patent Publication JP-A 11-311875 (1999). Still another prior technique discloses that a surface free energy is defined in the range of from 35 to 65 mN/m to improve cleanability of a surface of an electrophotographic photoreceptor and realize a long life thereof.

According to the present inventors' investigations, however, in the test of photography in which an image is actually formed on, for example, a recording paper using an electrophotographic photoreceptor having the surface free energy in the range disclosed in another prior technique, damage considered to occur by contact with foreign matters such as a paper powder and the like was confirmed on the surface of the electrophotographic photoreceptor. Further, it was also confirmed that owing to insufficient cleaning caused by this damage, black streaks occurred on images transferred on the recording paper. There was a tendency that the damage generated on the surface of the electrophotographic photoreceptor was increased with the increase in surface free energy.

In still another technique, an amount ($\Delta\gamma$) of change in surface free energy according to duration of an electrophotographic photoreceptor is defined. However, in consideration of the facts that the amount ($\Delta\gamma$) of change is not determined by defining initial characteristics, for example, the surface free energy, of the electrophotographic photoreceptor and the amount ($\Delta\gamma$) of change varies depending on conditions such as an environment in image formation and a material of a transfer member, the amount ($\Delta\gamma$) of change is problematic in that it might include an uncertain element and is therefore inappropriate as a designing standard in actual designing of an electrophotographic photoreceptor.

SUMMARY OF THE INVENTION

An object of the invention is to provide an electrophotographic photoreceptor which less damages the surface in long-term use by controlling surface properties, specifically, a surface free energy and which is excellent in cleanability without decreasing a quality of an image formed.

The invention provides an electrophotographic photoreceptor comprising a conductive substrate and a photoreceptive layer formed on the conductive substrate, the photoreceptive layer being uniformly charged and being exposed to light corresponding to an image information to form an electrostatic latent image, wherein a surface free energy ($\gamma$) on the surface of the photoreceptive layer is at least 20 mN/m and at most 35 mN/m, preferably at least 28 mN/m and at most 35 mN/m.

According to the invention, the surface free energy on the surface of the electrophotographic photoreceptor is determined to be at least 20 mN/m and at most 35 mN/m, preferably at least 28 mN/m and at most 35 mN/m. The surface free energy on the surface of the electrophotographic photoreceptor here referred to is calculated by the foregoing extended Forkes's theory. The surface free energy on the surface of the electrophotographic photoreceptor is an index of wettability, namely, adhesion of a developer, a paper powder and the like to the surface of the electrophotographic photoreceptor. The surface free energy is determined in the foregoing appropriate range, whereby excessive adhesion can be suppressed and adhesion of foreign matters such as a paper powder can be suppressed though adhesion necessary for development is exerted on a developer in particular. Thus, an excessive developer or foreign matters are easily removed from the surface of the electrophotographic photoreceptor. In this manner, the cleanability can be improved without decreasing the developability. Accordingly, since damage due to foreign matters adhered to the surface less occurs, an electrophotographic photoreceptor which has a long life and provides excellent durability stably over a long period of time without decreasing the quality of the image formed is realized.

In the invention, it is preferable that the photoreceptive layer is formed by laminating a charge generating layer containing a charge generating material and a charge transporting layer containing a charge transporting material.

According to the invention, the photoreceptive layer of the electrophotographic photoreceptor is formed by laminating a charge generating layer containing a charge generating material and a charge transporting layer containing a charge transporting material. The photoreceptive layer is thus formed by laminating plural layers to thereby freely select materials constituting the respective layers and their combinations. Consequently, the surface free energy value on the surface of the electrophotographic photoreceptor can easily be determined in a desired range.

In the invention it is preferable that the photoreceptive layer is a single layer structure containing a charge generating material and a charge transporting material.

According to the invention, by forming the photoreceptive layer as the single layer structure, it is possible to configure a single-layer photoreceptor which is appropriate as a photoreceptor for a positively charged image forming apparatus with less ozone generation. Since the photoreceptive layer is only one layer, it is excellent in production cost and yield in comparison to the laminated photoreceptive layer.

In the invention it is preferable that a vibration-proof member is mounted inside the conductive substrate.

According to the invention, the vibration-proof member is mounted inside the conductive substrate. Therefore, in using the electrophotographic photoreceptor for image formation, generation of abnormal noise or vibration is suppressed. Consequently, the electrophotographic photoreceptor excellent in tranquility is realized.

The invention provides an image forming apparatus comprising the electrophotographic photoreceptor mentioned above.

According to the invention, the image forming apparatus has the electrophotographic photoreceptor excellent in cleanability as recited in any of the foregoing inventions. Consequently, the image forming apparatus is provided which allows image formation stably over a long period of time without decreasing the image quality, and which reduces cost with low maintenance frequency.

BRIEF DESCRIPTION OF THE DRAWINGS

Other and further objects, features, and advantages of the invention will be more explicit from the following detailed description taken with reference to the drawings wherein.

DETAILED DESCRIPTION OF THE PREFERRED EMBODIMENTS

Figure 1:
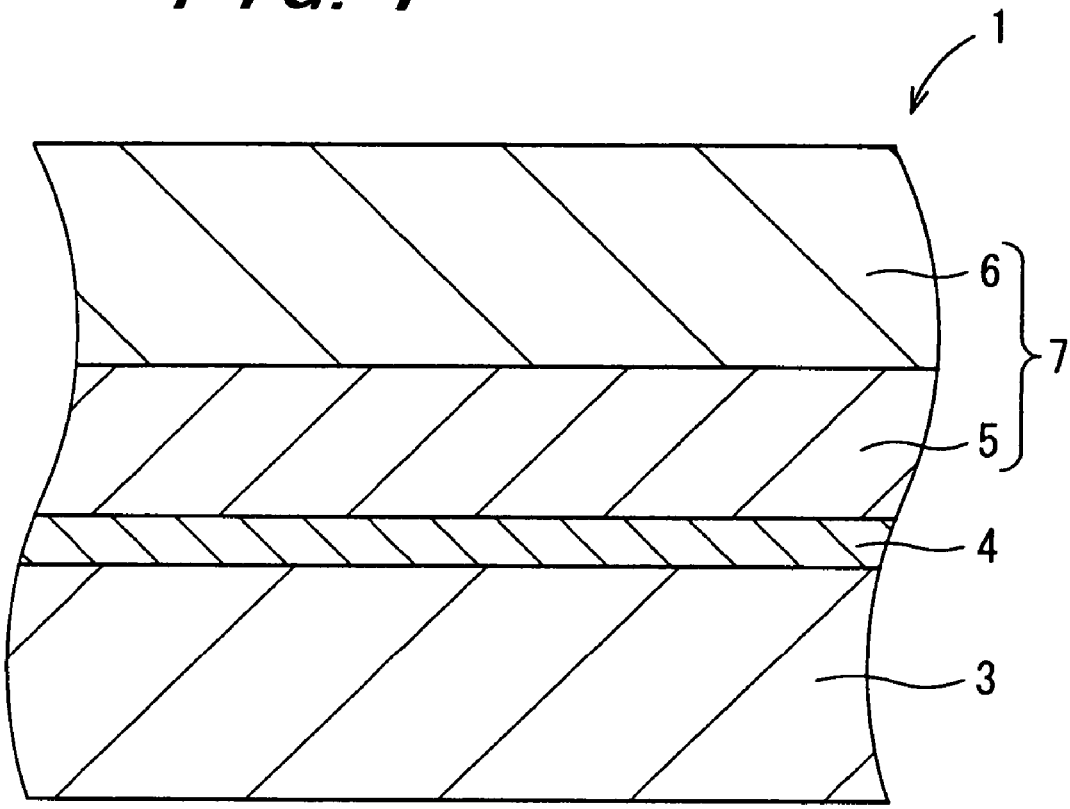
FIG. 1 is a partially sectional view schematically showing a structure of an electrophotographic photoreceptor according to a first embodiment of the invention.

Now referring to the drawings, preferred embodiments of the invention are described below.

Figure 2:
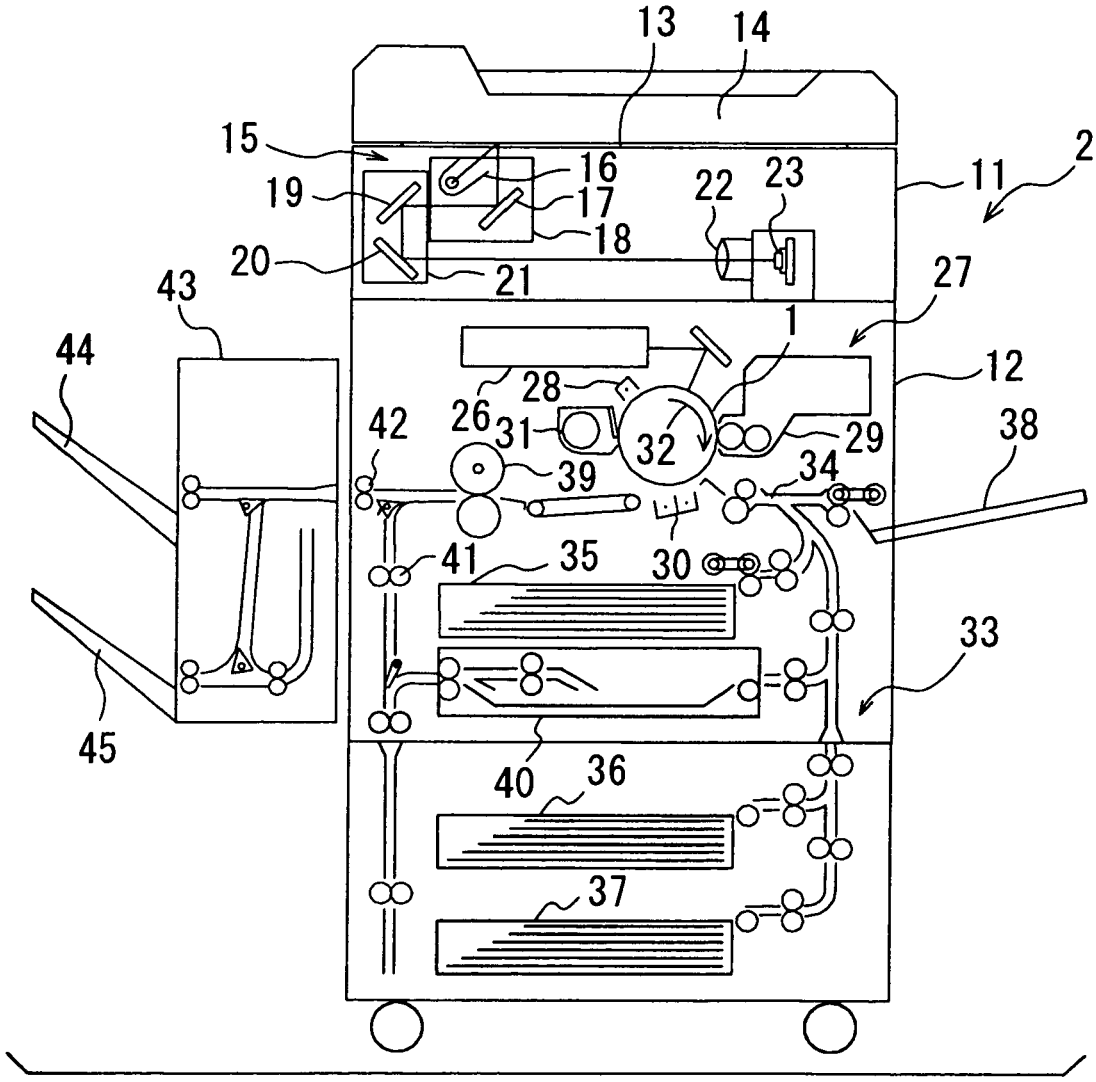
FIG. 2 is an installation side view schematically showing a structure of an image forming apparatus having the electrophotographic photoreceptor shown in FIG. 1, according to one embodiment of the invention.

FIG. 1 is a partially sectional view schematically showing a structure of an electrophotographic photoreceptor 1 according to a first embodiment of the invention. FIG. 2 is an installation side view schematically showing a structure of an image forming apparatus 2 having the electrophotographic photoreceptor shown in FIG. 1, according to one embodiment of the invention.

The electrophotographic photoreceptor (hereinafter abbreviated as photoreceptor) 1 comprises a conductive substrate 3 made of a conductive material, an undercoat layer 4 laminated on the conductive substrate 3, a charge generating layer 5 laminated on the undercoat layer 4 and containing a charge generating material, and a charge transporting layer 6 laminated on the charge generating layer 5 and containing a charge transporting material. The charge generating layer 5 and the charge transporting layer 6 constitute a photoreceptive layer 7.

The conductive substrate 3 has a cylindrical shape. A substrate obtained by forming a conductive layer of aluminum, copper, palladium, tin oxide or indium oxide on a surface of (a) a metallic material such as aluminum, stainless steel, copper or nickel or (b) an insulation material such as a polyester film, a phenolic resin pipe or a paper pipe is preferably used. It has preferably conductivity with volume resistivity of $10^{10}$ Ω·cm or less. The surface of the conductive substrate 3 may be oxidized for controlling the volume resistance. The conductive substrate 3 plays a part of an electrode of the photoreceptor 1 and also serves as a support member of the other layers 4, 5 and 6. The shape of the conductive substrate 3 is not limited to the cylindrical shape, and the substrate may be formed in a shape of a plate, a film or a belt.

The undercoat layer 4 is formed of, for example, a polyamide, a polyurethane, a cellulose, nitrocellulose, polyvinyl alcohol, polyvinyl pyrrolidone, polyacrylamide, an aluminum anodic oxide film, gelatin, starch, casein or an N-methoxymethylated nylon. Further, grains of titanium oxide, tin oxide, aluminum oxide or the like may be dispersed in the undercoat layer 4. The undercoat layer 4 is formed with the film thickness of from approximately 0.1 to 10 μm. This undercoat layer 4 plays a part of an adhesive layer between the conductive substrate 3 and the photoreceptive layer 7, and also serves as a barrier layer of inhibiting flow of charges from the conductive substrate 3 to the photoreceptive layer 7. The undercoat layer 4 thus acts to maintain chargeability of the photoreceptor 1, making it possible to prolong the life of the photoreceptor 1.

The charge generating layer 5 can contain a known charge generating material. As the charge generating material, any of an inorganic pigment, an organic pigment and an organic dye can be used so long as they absorb light to generate free charges. Examples of the inorganic pigment include selenium, its alloy, arsenic-selenium, cadmium sulfide, zinc oxide, amorphous silicon and other inorganic photoconductors. Examples of the organic pigment include a phthalocyanine compound, an azo compound, a quinacridone compound, a polycyclic quinone compound, a perylene compound and the like. Examples of the organic dye include a thiapylylium salt and a squalilium salt. Among the charge generating materials, a phthalocyanine compound is preferably used. A titanylphthalocyanine compound is most preferable. A combination of it with a butadiene compound provides good sensitivity, chargeability and reproducibility in particular.

In addition to the pigments and dyes listed above, the charge generating layer 5 may contain a chemical sensitizer or an optical sensitizer. Examples of the chemical sensitizer include electron acceptors, for example, cyano compounds such as tetracyanoethylene and 7,7,8,8-tetracyanoquinodimethane, quinones such as anthraquinone and p-benzoquinone, and nitro compounds such as 2,4,7-trinitrofluorenone and 2,4,5,7-tetranitrofluorenone. Examples of the optical sensitizer include colorants such as a xanthene colorant, a thiazine colorant and a triphenylmethane colorant.

The charge generating layer 5 is formed by dispersing the foregoing charge generating material in an appropriate solvent along with a binder resin, laminating the dispersion on the undercoat layer 4, and drying or curing the laminate. Specific examples of the binder resin include a polyallylate, polyvinyl butyral, a polycarbonate, a polyester, a polystyrene, polyvinyl chloride, a phenoxy resin, an epoxy resin, silicone, a polyacrylate and the like. Examples of the solvent include isopropyl alcohol, cyclohexanone, cyclohexane, toluene, xylene, acetone, methyl ethyl ketone, tetrahydrofuran, dioxane, dioxolane, ethyl cellosolve, ethyl acetate, methyl acetate, dichloromethane, dichloroethane, monochlorobenzene, ethylene glycol dimethyl ether and the like.

The solvent is not limited to the foregoing ones, and may be selected from alcohol, ketone, amide, ester, ether, hydrocarbon, chlorohydrocarbon and aromatic solvents. They may be used either singly or in combination. However, in consideration of the decrease in sensitivity owing to crystal transformation in pulverization and milling of the charge generating material and the decrease in properties due to pot life, it is preferable to use any of cyclohexanone, 1,2-dimethoxyethane, methyl ethyl ketone and tetrahydroquinone that less cause crystal transformation in inorganic or organic pigments.

A gaseous-phase deposition method such as a vacuum deposition method, a sputtering method or a CVD method, or a coating method can be applied to formation of the charge generating layer 5. In case of using the coating method, a coating solution obtained by pulverizing the charge generating material with a ball mill, a sand grinder, a paint shaker or an ultrasonic dispersing machine, dispersing the powder in a solvent and adding a binder resin as required is coated on the undercoat layer 4 by a known coating method. When the conductive substrate 3 formed on the undercoat layer 4 is cylindrical, a spraying method, a vertical ring method, a dip-coating method or the like can be used as a coating method. The film thickness of the charge generating layer 5 is preferably from approximately 0.05 to 5 μm, more preferably from approximately 0.1 to 1 μm.

When the conductive substrate 3 formed on the undercoat layer 4 is a sheet, a baker applicator, a bar coater, casting, spin coating or the like can be used in the coating method.

The charge transporting layer 6 can contain a known charge transporting material and a binder resin. Any charge transporting material can be used so long as it has an ability to receive charges generated in the charge generating material contained in the charge generating layer 5 and transport the same. Examples of the charge transporting material include electron-donating compounds such as poly-N-vinylcarbazole and its derivatives, poly-g-carbazolyl ethylglutamate and its derivatives, polyvinylpyrene, polyvinylphenanthrene, oxazole derivatives, oxadiazole derivatives, imidazole derivatives, 9-(p-diethylaminostyryl) anthracene, 1,1-bis(4-dibenzylaminophenyl)propane, styrylanthracene, styrylpyrazoline, pyrazoline derivatives, phenylhydrazones, hydrazone derivatives, a triphenylamine compound, a tetraphenyldiamine compound, a stilbene compound and an azine compound having a 3-methyl-2-benzothiazoline ring.

As the binder resin constituting the charge transporting layer 6, any binder resin can be used so long as it has compatibility with the charge transporting material. Examples thereof include a polycarbonate, a copolycarbonate, a polyallylate, polyvinyl butyral, a polyamide, a polyester, an epoxy resin, a polyurethane, a polyketone, a polyvinyl ketone, a polystyrene, polyacrylamide, a phenolic resin, a phenoxy resin, a polysulfone resin and resin copolymers thereof. These resins may be used either singly or in combination. Of these binder resins, resins such as a polystyrene, a polycarbonate, a copolycarbonate, a polyallylate and a polyester have volume resistance of $10^{13}$ Ω or more, and are excellent in film formability and potential properties.

As the solvent that dissolves these materials, alcohols such as methanol and ethanol, ketones such as acetone, methyl ethyl ketone and cyclohexanone, ethers such as ethyl ether, tetrahydrofuran, dioxane and dioxolane, halogenated aliphatic hydrocarbons such as chloroform, dichloromethane and dichloroethane and aromatics such as benzene, chlorobenzene and toluene can be used.

The coating solution for forming the charge transporting layer 6 is prepared by dissolving the charge transporting material in the binder resin solution. The ratio of the charge transporting material occupied in the charge transporting layer 6 is preferably in the range of from 30 to 80% by weight. The formation of the charge transporting layer 6 on the charge generating layer 5 is performed in the same manner as the formation of the charge generating layer 5 on the undercoat layer 4. The film thickness of the charge transporting layer 6 is preferably from 10 to 50 μm, more preferably from 15 to 40 μm.

The charge transporting layer 6 may contain at least one electron acceptor material or colorant to improve sensitivity and suppress the increase in residual potential or fatigue in repetitive use. Examples of the electron acceptor material include acid anhydrides such as succinic anhydride, maleic anhydride, phthalic anhydride and 4-chloronaphthalic anhydride, cyano compounds such as tetracyanoethylene, terephthalmalondinitrile, aldehydes such as 4-nitrobenzaldehyde, anthraquinones such as anthraquinone and 1-nitroanthraquinone, polycyclic or heterocyclic nitro compounds such as 2,4,7-trinitrofluorenone and 2,4,5,7-tetranitrofluorenone. These can be used as a chemical sensitizer.

Examples of the colorant include organic photoconductive compounds such as a xanthene colorant, a thiazine colorant, a triphenylmethane colorant, a quinoline pigment and copper phthalocyanine. These can be used as an optical sensitizer.

The charge transporting layer 6 may further contain a known plasticizer to improve film formability, flexibility and mechanical strength. Examples of the plasticizer include a dibasic acid ester, a fatty acid ester, a phosphoric ester, a phthalic ester, a chlorinated paraffin, an epoxy-type plasticizer and the like. The photoreceptive layer 7 may contain, as required, a leveling agent for preventing orange peel, such as polysiloxane, a phenolic compound for improving durability, an antioxidant such as a hydroquinone compound, a tocopherol compound or an amine compound, an ultraviolet light absorber and the like.

The surface free energy (γ) on the surface of the photoreceptor 1 constructed above, namely, the surface of the photoreceptive layer 7 is determined such that the value calculated by the extended Forkes's theory is at least 20 mN/m and at most 35 mN/m, preferably at least 28 mN/m and at most 35 mN/m.

When the surface free energy is less than 20 mN/m, disadvantages notably occur due to the decrease in adhesion of the toner or the like to the photoreceptor. For example, the decrease in adhesion of the toner or the like to the photoreceptor leads to the increase in transferability, which results in decreasing the residual toner sent to a cleaning blade.

Consequently, inversion of a blade or a blade skip mark occurs in the photoreceptor to invite the decrease in image quality. Further, with the decrease in adhesion, the toner scattering is accelerated, and an adverse effect due to the scattered toner is observed on the front or back of the recording paper.

When the surface free energy exceeds 35 mN/m, the adhesion of the toner, the paper powder or the like to the surface of the photoreceptor is increased, and the surface of the photoreceptor tends to damage. The surface damage worsens the cleanability. Consequently, the surface free energy has been determined to be from 20 to 35 mN/m.

The surface free energy on the surface of the photoreceptor 1 is determined within the foregoing range in the following manner. It can be realized by introducing a material having a relatively low surface free energy value, for example, a fluorine-containing material typified by polytetrafluoroethylene (PTFE) or a polysiloxane material into the photoreceptive layer 7 and adjusting its content. Further, it can be realized by varying the types of the charge generating material, the charge transporting material and the binder resin contained in the photoreceptive layer 7 and the composition ratio thereof. Still further, it can be realized by controlling a drying temperature in forming the photoreceptive layer 7.

The surface free energy on the surface of the photoreceptor 1 which is determined in this manner is obtained by measuring adhesions with known reagents used as the dipolar component, the dispersion component and the hydrogen-bonding component of the surface free energy. Specifically, contact angles to the surface of the photoreceptor 1 are measured with a contact angle meter CA-X (trade name: manufactured by Kyowa Kaimen K.K.) using pure water, methylene iodide and α-bromonaphthalene as reagents. The surface free energies of the respective components can be calculated on the basis of the measured results using a surface free energy analysis software EG-11 (trade name: manufactured by Kyowa Kaimen K.K.) Incidentally, the reagents are not limited to the foregoing pure water, methylene iodide and α-bromonaphthalene, and an appropriate combination of reagents can be used as the dipolar component, the dispersion component and the hydrogen-bonding component. The measuring method is not limited to the foregoing method. For example, the Wilhelmy method (hanging plate method) or the Du Nouy method is also available.

Formation of an electrostatic latent image in the photoreceptor 1 is briefly described below. The photoreceptive layer 7 formed on the photoreceptor 1 is, for example, negatively charged uniformly with a charging unit. When light having an absorption wavelength is applied to the charge generating layer 5 in the charged state, charges of electrons or holes are generated in the charge generating layer 5. The holes are moved to the surface of the photoreceptor 1 by the charge transporting material contained in the charge transporting layer 6 to neutralize negative charges of the surface. The electrons in the charge generating layer 5 are moved to the conductive substrate 3 with positive charges induced to neutralize positive charges. Thus, in the photoreceptive layer 7, a difference is provided between the charge amount of the exposed site and the charge amount of the unexposed site to form an electrostatic latent image.

A structure and image formation of an image forming apparatus 2 having the foregoing photoreceptor 1 is described below by referring to FIG. 2. The image forming apparatus 2 shown as an embodiment of the invention is a digital copying machine 2.

The digital copying machine 2 comprises a scanner portion 11 and a laser recording portion 12. The scanner portion 11 includes an original mounting base 13 made of a transparent glass, a double-side-available automatic original feeder (RADF) 14 for automatically feeding an original to the original mounting base 13 and a scanner unit 15 which is an original image reading unit for scanning and reading an image of the original mounted on the original mounting base 13. The original image read with the scanner portion 11 is sent to an image data input portion to be described later as an image data where the image data is subjected to predetermined image treatment. Plural originals are set at a time on an original tray (not shown) provided on RADF 14, and the originals set are automatically fed to the original mounting base 13 one by one. In order to allow the scanner unit 15 to read one side or both sides of the original according to the operator's selection, RADF 14 includes a transport route for a one-sided original, a transport route for a double-sided original, a transport route switch-over unit, a sensor group for grasping and managing the condition of the original passed through each portion, a control portion and the like.

The scanner unit 15 includes a lamp reflector assembly 16 for exposing the surface of the original, a first scanning unit 18 fitted with a first reflection mirror 17 for reflecting reflected light from the original to lead a reflected light image of the original to a photoelectric conversion device (for example, a CCD image sensor) 23, a second scanning unit 21 fitted with second and third reflection mirrors 19, 20 for leading a reflected light image of the first reflection mirror 17 to the CCD image sensor 23, an optical lens 22 for forming an image on the CCD image sensor 23 that converts the reflected light image of the original to electric image signals via the foregoing reflection mirrors 17, 19, 20, and the CCD image sensor 23.

The scanner portion 11 is adapted to feed and mount the original to be read on the original mounting base 13 by relative operation of RADF 14 and the scanner unit 15 and read the original images upon moving the scanner unit 15 along the lower surface of the original mounting base 13. The first scanning unit 18 is scanned at a fixed rate V in the reading direction of the original images (from left to right toward the paper surface in FIG. 2) along the original mounting base 13, and the second scanning unit 21 is scanned in parallel in the same direction at a half rate (V/2) of the rate V. By the operations of the first and second scanning units 18, 21, the original images mounted on the original mounting base 13 can be formed on the CCD image sensor 23 in sequence at every line to read the images.

The image data obtained by reading the original images with the scanner unit 15 are sent to an image treating portion to be described later where they are subjected to various image treatments. The resulting images are then once stored in a memory of the image treating portion, and the images in the memory are read according to output instructions, sent to a laser recording portion 12, and formed on a recording paper as a recording medium.

The laser recording portion 12 has a recording paper transport system 33, a laser writing unit 26 and an electrophotographic processing portion 27 for forming images. The laser writing unit 26 includes image data which are read by the scanning unit 15 and stored in the memory and then read out from the memory, a semiconductor laser source for emitting a laser beam according to the image data sent from an external device, a polygon mirror for polarizing the laser beam at a conformal rate, an f-θ lens for correcting the laser beam polarized at the conformal rate such that it is polarized at the conformal rate on the photoreceptor 1 mounted on the electrophotographic processing portion 27.

In the electrophotographic processing portion 27, a charging unit 28, a developing unit 29, a transfer unit 30 and a cleaning unit 31 are mounted in this order around the photoreceptor 1 from an upstream side to a downstream side in a rotational direction of the photoreceptor 1 as shown by an arrow 32. As stated above, the photoreceptor 1 is uniformly charged with the charging unit 28, and exposed in the charged state to a laser beam corresponding to the original image data which beam is emitted from the laser writing unit 26. The electrostatic latent images formed on the surface of the photoreceptor 1 by exposure are developed with a toner supplied from the developing unit 29 to form toner images as visible images. The toner images formed on the surface of the photoreceptor 1 are transferred onto a recording paper fed by a transport system 33 to be described later through the transfer unit 30.

At this time, the surface free energy on the surface of the photoreceptor 1 is determined in the preferable range. Accordingly, the toner that forms the toner images is easily moved and transferred on the recording paper from the surface of the photoreceptor 1 to less generate the remaining toner and less adhere a paper powder of the recording paper contacted in the transfer to the surface of the photoreceptor 1. Consequently, it is possible to set a week polishing force of the cleaning blade of the cleaning unit 31 mounted for cleaning the surface of the photoreceptor 1 after the transfer and also set a low contact pressure of the cleaning blade to the surface of the photoreceptor 1. The life of the photoreceptor 1 is therefore prolonged. Further, since the surface of the photoreceptor 1 is always kept clean without adhesion of a toner or foreign matters, images having a good image quality can be formed stably for a long period of time.

A transport system 33 of the recording paper includes a transport portion 34 for transporting a recording paper to a transfer position on which especially the transfer unit 30 of the electrophotographic processing portion 27 for image formation is mounted, first to third cassette feeders 35, 36, 37 for feeding the recording paper to the transport portion 34, a manual paper feeder 38 for properly feeding a recording paper of a desired size, a fixing unit 39 for fixing images, especially toner images transferred from the photoreceptor 1 to the recording paper, and a re-feeding route 40 for re-feeding the recording paper for forming the images on the back (opposite to the surface on which the toner images are formed) of the recording paper after fixing the toner images. Many transport rollers 41 are mounted on the transport route of the transport system 33, and the recording paper is transported to a predetermined position in the transport system 33 by the transport rollers 41.

The recording paper on which the toner images are fixed with the fixing unit 39 is fed to the re-feeding route 40 for image formation on the back, or fed to a post treatment device 43 with exhaust rollers 42. The recording paper fed to the re-feeding route 40 is repetitively subjected to the foregoing procedures to form the images on the back. The recording paper fed to the post treatment device 43 is subjected to the post treatment, then exhausted to a first or second exhaust cassette 44 or 45 which is determined according to the post treatment to complete a series of image formation procedures in the digital copying machine 2.

The digital copying machine 2 is equipped with the photoreceptor 1 having excellent cleanability which can easily be cleaned with the cleaning unit 31 because the toner is not excessively adhered and the foreign matters are less adhered. Images can therefore be formed stably over a long period of time without decreasing the image quality. Further, the life of the photoreceptor 1 is long, and the cleaning unit 31 is also simple. Accordingly, the apparatus with low maintenance frequency is realized at low cost.

Figure 3A:
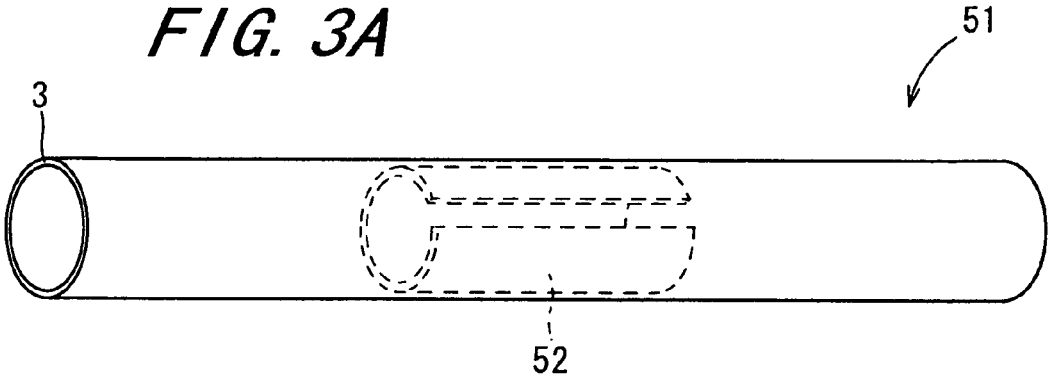
FIGS. 3A and 3B are perspective views schematically showing a structure of a photoreceptor according to a second embodiment of the invention.
Figure 3B:
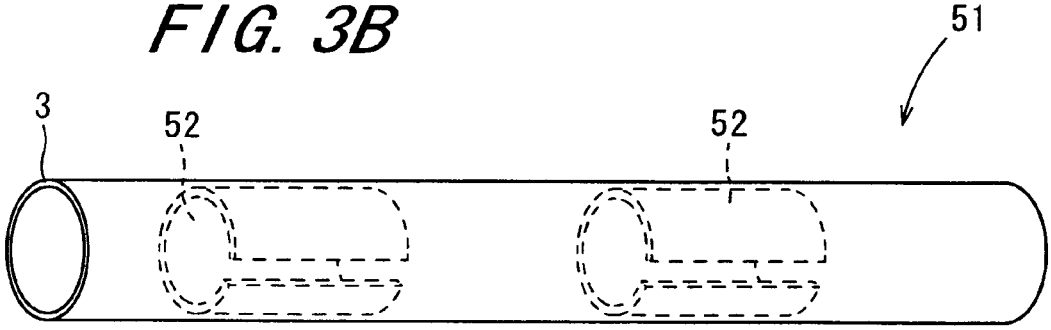

FIGS. 3A and 3B are perspective views schematically showing a structure of the photoreceptor 51 which is a second embodiment of the invention. The photoreceptor 51 according to this embodiment is similar to the photoreceptor 1 according to the first embodiment of the invention, and is characterized in that a vibration-proof member 52 is further mounted inside the conductive substrate 3 of the photoreceptor 1 as the first embodiment. FIG. 3A shows a case in which one vibration-proof member 52 is mounted inside the conductive substrate 3, and FIG. 3B shows a case in which two vibration-proof members 52 are mounted inside the conductive substrate 3. Since the photoreceptive layer 7 and the undercoat layer 4 constituting the photoreceptor 51 are thin, they are not shown in FIGS. 3A and 3B.

As a material of the vibration-proof member 52, a viscoelastic material, for example, a synthetic resin foam such as a polyolefin foam, a polystyrene foam, a polyurethane foam, a polyvinyl chloride foam or a fluororubber foam is preferably used. In this embodiment, the vibration-proof member 52 is formed into a flat plate. The vibration-proof member 52 in the form of the flat plate is formed in a cylindrical shape, and then inserted into the conductive substrate 3. The vibration-proof member 52 inserted into the conductive substrate 3 is tried to restore the original flat plate, and is fixed within the conductive substrate 3 with this restoration force. Since the vibration-proof member 52 is mounted in this manner to suppress occurrence of abnormal noise or vibration in using the photoreceptor 51 for image formation, the photoreceptor 51 excellent in tranquility is realized.

Here, the case in which one or two vibration-proof members 52 are mounted in the photoreceptor 51 is described. However, this is not critical, and more vibration-proof members may be inserted into the conductive substrate. Further, it is not critical to insert the vibration-proof member by forming the flat plate in the cylindrical shape. It is possible to insert the vibration-proof member which has already been formed in a cylindrical or columnar shape. It is also possible that a foamable material and a foaming agent are charged in the conductive substrate and the foamable material is foamed to fill the conductive substrate with the vibration-proof member. Thus, various modifications are permitted so long as they meet the object of the invention.

Figure 4:
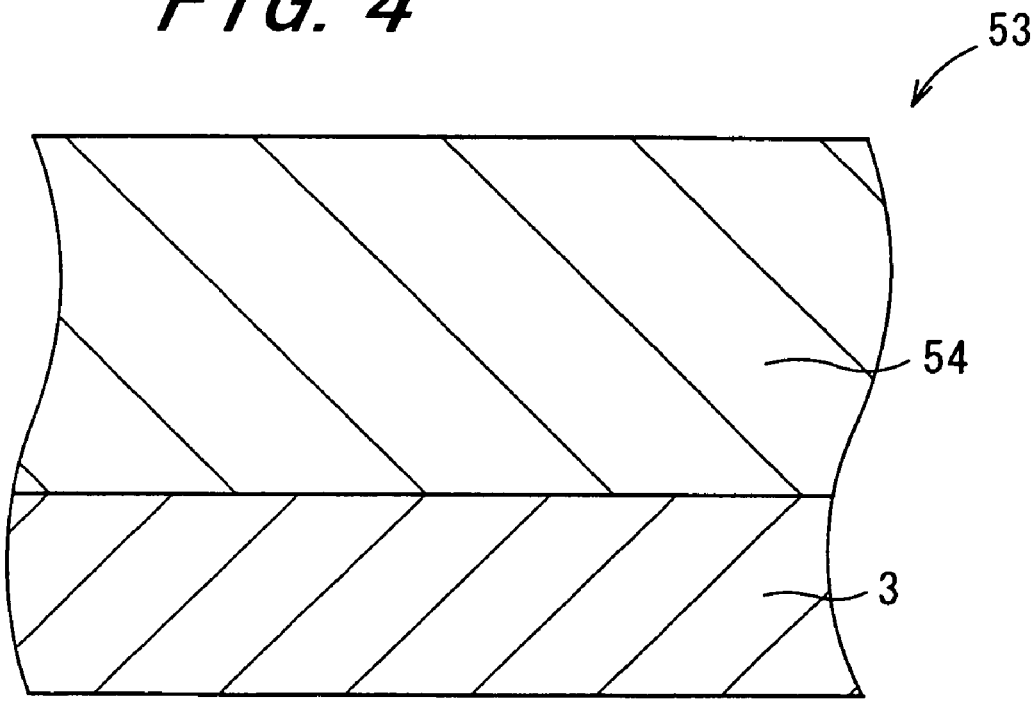
FIG. 4 is a partially sectional view schematically showing a structure of a photoreceptor according to a third embodiment of the invention.

FIG. 4 is a partially sectional view schematically showing a structure of a photoreceptor 53 which is a third embodiment of the invention. The photoreceptor 53 according to this embodiment is similar to the photoreceptor 1 according to the first embodiment of the invention. The same reference numerals are allotted to the corresponding portions, and the description thereof is omitted. In the photoreceptor 53, it is noteworthy that a photoreceptive layer 54 made of a single layer is formed on the conductive substrate 3.

The photoreceptive layer 54 is formed using the same charge generating material, charge transporting material and binder resin as used in the photoreceptor 1 according to the first embodiment of the invention. The photoreceptive layer of the single layer is formed on the conductive substrate 3 by the same method in which the charge generating layer 5 in the photoreceptor 1 according to the first embodiment of the invention is formed using a coating solution for a photoreceptive layer prepared by dispersing the charge generating material and the charge transporting material into the binder resin or dispersing the charge generating material in the photoreceptive layer containing the charge transporting material in the form of pigment grains. The single-layer photoreceptor 53 of this embodiment is appropriate as a photoreceptor for a positively charged image forming apparatus with less ozone generation, and the photoreceptive layer 54 to be coated is only one layer. Accordingly, it is excellent in production cost and yield in comparison to the laminated photoreceptive layer formed by laminating the charge generating layer and the charge transporting layer.

EXAMPLES

Examples of the invention are described below.

First, photoreceptors in Examples and Comparative Examples which were prepared by forming a photoreceptive layer on an aluminum conductive substrate having a diameter of 30 mm and a length of 326.3 under various conditions are described below.

Examples S1 to S7

Example S1

Seven parts by weight of titanium oxide (TTO55A: manufactured by Ishihara Sangyo Kaisha Ltd.) and 13 parts by weight of co-nylon (CM8000: manufactured by Toray Industries Inc.) were added to a mixed solvent of 159 parts by weight of methyl alcohol and 106 parts by weight of 1,3-dioxorane, and dispersed with a paint shaker for 8 hours to prepare a coating solution for an undercoat layer. This coating solution was charged into a coating bath. A conductive substrate was dipped therein, then withdrawn therefrom, and dried with air to form an undercoat layer having a thickness of 1 μm.

Three parts by weight of oxotitanylphthalocyanine and 2 parts by weight of a butyral resin (BL-1: manufactured by Sekisui Chemical Co., Ltd.) were mixed with 245 parts by weight of methyl ethyl ketone, and dispersed with a paint shaker to prepare a coating solution for a charge generating layer. This coating solution was coated on the undercoat layer by the same dip-coating method as in the undercoat layer, and dried with air to form a charge generating layer having a thickness of 0.4 μm.

Five parts by weight of a styryl compound represented by the following structural formula (1) as a charge transporting material, 2.25 parts by weight of a polyester resin (Vylon 290: manufactured by Toyobo Co., Ltd.), 5.25 parts by weight of a polycarbonate resin (G400: manufactured by Idemitsu Petrochemical Co., Ltd.) and 0.05 part by weight of Sumilizer BHT (manufactured by Sumitomo Chemical Co., Ltd.) were mixed, and 47 parts by weight of tetrahydrofuran was used as a solvent to prepare a coating solution for a charge transporting layer. This coating solution was coated on the charge generating layer by a dip-coating method, and dried at 110° C. for 1 hour to form a charge transporting layer having a thickness of 28 μm. In this manner, the photoreceptor in Example S1 was produced.

(1)

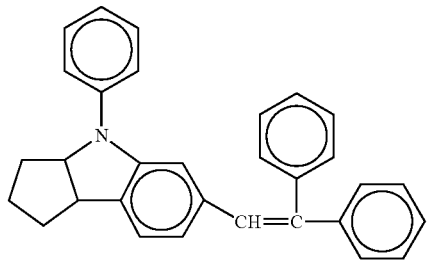

Example S2

An undercoat layer and a charge generating layer were formed as in Example S1. Subsequently, 5 parts by weight of a butadiene compound represented by the following structural formula (2) as a charge transporting material, four types of polycarbonate resins, 2.4 parts by weight of J500 (manufactured by Idemitsu Petrochemical Co., Ltd.), 1.6 parts by weight of G400 (manufactured by Idemitsu Petrochemical Co., Ltd.), 1.6 parts by weight of GH503 (manufactured by Idemitsu Petrochemical Co., Ltd.) and 2.4 parts by weight of TS2020 (manufactured by Teijin Kasei K.K.), and 0.25 part by weight of Sumilizer BHT (manufactured by Sumitomo Chemical Co., Ltd.) were mixed, and 49 parts by weight of tetrahydrofuran was used as a solvent to prepare a coating solution for a charge transporting layer. This coating solution was coated on a charge generating layer by a dip-coating method, and dried at 130° C. for 1 hour to form a charge transporting layer having a thickness of 28 μm. In this manner, the photoreceptor in Example S2 was produced.

(2)

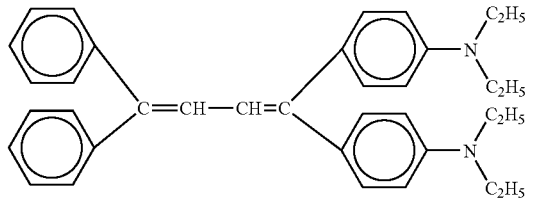

Example S3

A photoreceptor was produced as in Example S2. After the production, a vibration-proof member made of a polyurethane foam and having a thickness of 5 mm, a width of 70 mm and a length of 150 mm was formed in a cylindrical shape, and inserted into the conductive substrate making up the photoreceptor. In this manner, the photoreceptor having the vibration-proof member in Example S3 was produced.

Example S4

A photoreceptor in Example S4 was produced as in Example S2 except that in the formation of a charge transporting layer, 4.4 parts by weight of GH503 (manufactured by Idemitsu Petrochemical Co., Ltd.) and 4 parts by weight of TS2020 (manufactured by Teijin Kasei K.K.) were used as polycarbonate resins.

Example S5

An undercoat layer and a charge generating layer were formed as in Example 1. Subsequently, 3.5 parts by weight of the butadiene compound represented by the structural formula (2) as a charge transporting material, 1.5 parts by weight of a styryl compound represented by the following structural formula (3), four types of polycarbonate resins, 2.2 parts by weight of J500 (manufactured by Idemitsu Petrochemical Co., Ltd.), 2.2 parts by weight of G400 (manufactured by Idemitsu Petrochemical Co., Ltd.), 1.8 parts by weight of GH503 (manufactured by Idemitsu Petrochemical Co., Ltd.) and 1.8 parts by weight of TS2020 (manufactured by Teijin Kasei K.K.), and 1.5 part by weight of Sumilizer BHT (manufactured by Sumitomo Chemical Co., Ltd.) were mixed, and 55 parts by weight of tetrahydrofuran was used as a solvent to prepare a coating solution for a charge transporting layer. This coating solution was coated on a charge generating layer by a dip-coating method, and dried at 120° C. for 1 hour to form a charge transporting layer having a thickness of 28 μm. In this manner, the photoreceptor in Example S5 was produced.

(3)

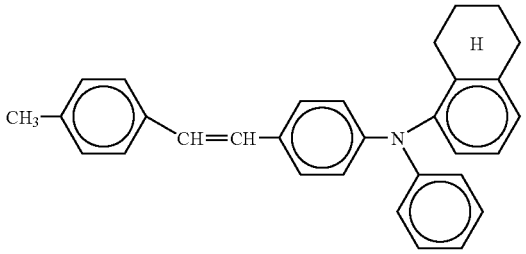

Examples S6 and S7

An undercoat layer and a charge generating layer were formed as in Example S1. Subsequently, a coating solution was prepared as in Example S2 except that polytetrafluoroethylene (PTFE), a resin having a low surface free energy (γ) was used in place of a part of polycarbonate resins in forming a charge transporting layer. This coating solution was coated on the charge generating layer by a dip-coating method, and dried at 120° C. for 1 hour to form a charge transporting layer having a thickness of 28 μm. The photoreceptors were produced respectively such that the content of PTFE occupied in the coating solution for forming a charge transporting layer was higher in Example S6 than in Example S7 and γ of the photoreceptor in Example S6 was lower than γ of the photoreceptor in Example S7.

Comparative Example P1

An undercoat layer and a charge generating layer were formed as in Example S1. Subsequently, 5 parts by weight of the butadiene compound represented by the structural formula (2) as a charge transporting material, three types of resins, 2.4 parts by weight of G400 (manufactured by Idemitsu Petrochemical Co., Ltd.), 4 parts by weight of TS2020 (manufactured by Teijin Kasei K.K.) and 1.6 parts by weight of Vylon 290 (manufactured by Toyobo Co., Ltd.), and 0.25 part by weight of Sumilizer BHT (manufactured by Sumitomo Chemical Co., Ltd.) were mixed, and 49 parts by weight of tetrahydrofuran was used as a solvent to prepare a coating solution for a charge transporting layer. This coating solution was coated on the charge generating layer by a dip-coating method, and dried at 130° C. for 1 hour to form a charge transporting layer having a thickness of 28 μm. In this manner, the photoreceptor in Comparative Example P1 was produced.

Comparative Example P2

An undercoat layer and a charge generating layer were formed as in Comparative Example P1. Subsequently, 5 parts by weight of the butadiene compound represented by the structural formula (2) as a charge transporting material, two types of polycarbonate resins, 4.4 parts by weight of J500 (manufactured by Idemitsu Petrochemical Co., Ltd.) and 3.6 parts by weight of TS2020 (manufactured by Teijin Kasei K.K.), and 0.25 part by weight of Sumilizer BHT (manufactured by Sumitomo Chemical Co., Ltd.) were mixed, and 49 parts by weight of tetrahydrofuran was used as a solvent to prepare a coating solution for a charge transporting layer. This coating solution was coated on the charge generating layer by a dip-coating method, and dried at 120° C. for 1 hour to form a charge transporting layer having a thickness of 28 μm. In this manner, the photoreceptor in Comparative Example P2 was produced.

Comparative Example P3

A photoreceptor in Comparative Example P3 was produced as in Comparative Example P2 except that 4.4 parts by weight of J500 (manufactured by Idemitsu Petrochemical Co., Ltd.) was replaced with G400 (manufactured by Idemitsu Petrochemical Co., Ltd.) as a polycarbonate resin in the formation of a charge transporting layer.

Comparative Example P4

An undercoat layer and a charge generating layer were formed as in Comparative Example P1. Subsequently, in the formation of a charge transporting layer, a coating solution was prepared as in Comparative Example P1 except that PTFE, a resin having low γ was used instead of a part of polycarbonate resins. This coating solution was coated on the charge generating layer by a dip-coating method, and dried at 120° C. for 1 hour to form a charge transporting layer having a thickness of 28 μm. In this manner, the photoreceptor in Comparative Example P4 was produced.

As described above, in the production of the photoreceptors in Examples S1 to S7 and Comparative Examples P1 to P4, the surface free energies (γ) on the surfaces of the photoreceptors were adjusted to desired values by varying the types and contents of the resins contained in the coating solutions for a charge transporting layer and also varying the drying temperature after the coating. The surface free energies (γ) on the surfaces of the photoreceptors in Examples S1 to S7 and Comparative Examples P1 to P4 were measured using a contact angle measuring device CA-X (manufactured by Kyowa Kaimen K.K.) and an analysis soft EG-11 (manufactured by Kyowa Kaimen K.K.).

The photoreceptors in Examples S1 to S7 and Comparative Examples P1 to P4 were mounted in a digital copying machine AR-450 (manufactured by Sharp Corporation)

remodeled for test, and subjected to image formation. Tests for evaluation of cleanability, image stability, tranquility and surface roughness were then performed. Methods of evaluating the respective properties are described below.

[Cleanability]; A contact pressure by which a cleaning blade of a cleaning unit mounted on the digital copying machine AR-450 is contacted with the photoreceptor, a so-called cleaning blade pressure was adjusted to 21 gf/cm ($2.06\times10^{31\ 1}$ N/cm) in terms of an initial linear pressure. A letter test chart manufactured by Sharp Corporation was copied on 100,000 sheets of a recording paper SF-4AM3 (manufactured by Sharp Corporation) in a normal temperature/normal humidity (N/N) environment of temperature: 25° C. and relative humidity: 50% using the copying machine.

In Examples, the letter test chart and the recording paper were also used in the other evaluation tests to be described later. Images formed were visually observed at respective stages, in beginning of image formation (0 k), and after image formation of 25,000 (25 k) sheets, 50,000 (50 k) sheets and 100,000 (100 k) sheets to examine sharpness in the interface between black and white two colors and occurrence of a black streak due to toner leakage in the rotational direction of the photoreceptor. Further, a fog amount Wk was measured with a measuring unit to be described later. In this manner, the cleanability was evaluated. The fog amount Wk of the image formed was obtained by measuring a reflection density using Z-Σ90 COLOR MEASURING SYSTEM manufactured by Nippon Denshoku Ind. Co., Ltd. First, an average reflection density Wr of the recording paper before image formation was measured. Then, the recording paper was subjected to image formation. After the image formation, a reflection density in each blank portion of the recording paper was measured. Wk obtained from a reflection density Ws of a portion estimated to have the largest fog amount, namely, a blank portion with the highest density and Wr using the following formula $$\{100\times(Wr-Ws)/Wr\}$$

was defined as a fog amount.

The criteria of the cleanability are as follows.

⊚: very good with good sharpness and no black streak.

The fog amount Wk is less than 3%.

○: good with good sharpness and no black streak. The fog amount Wk is at least 3% and less than 5%.

Δ: no problem in practical use. Sharpness is at a level which is not problematic in practical use, and a length of black streak is 2.0 mm or less and the number of black streaks is 5 or less. The fog amount Wk is atleast 5% and less than 10%.

X: actually unusable. Sharpness is problematic in practical use. Black streak exceeds the range of Δ. The fog amount Wk is 10% or more.

[Image Stability]

In the same manner as in the evaluation of the cleanability, black solid test chart were used. In beginning of image formation (0 k) and after image formation of 25 k sheets, 50 k sheets and 100 k sheets, a reflection density Dr of the recording paper in beginning of image formation and a reflection density Ds of the recording paper after each durable print number of sheets were measured using Machbes RD918 manufactured by Sakata Inks K.K. to perform a test for evaluation of image stability. ΔD obtained from the reflection densities Dr and Ds using the formula $\{100\times(Dr-Ds)/Dr=\Delta D\}$ was defined as an image density decrease level. The image stability was evaluated with the image density decrease level ΔD.

The criteria of the image stability are as follows.

⊚: very good with ΔD of less than 5%.

○: good with ΔD of at least 5% and less than 10%.

Δ: slightly bad with AD of at least 10% and less than 20%.

x: bad with ΔD of at least 20%.

[Tranquility]

A letter test chart was copied on 100,000 sheets of a recording paper in a high temperature/high humidity (H/H) environment of temperature:35° C. and relative humidity: 85% using a copying machine initially set at the same cleaning blade pressure as in the evaluation of the cleanability. Before image formation (0 k) and after image formation of 25 k sheets, 50 k sheets and 100 k sheets, an abnormal vibration sound, a so-called "noise" caused by friction between the photoreceptor and the cleaning blade was detected by hearing of an operator.

The criteria of the tranquility are as follows.

⊚: very good without noise.

⊚: good. Noise occurs in either the start-up or the completion of the rotation of the photoreceptor.

Δ: slightly bad. Noise occurs in both the start-up and the completion of the rotation of the photoreceptor.

X: bad. Noise occurs continuously during the rotation of the photoreceptor.

[Surface Roughness]

Image formation of 100 k sheets was performed under the same conditions as in the evaluation test of the cleanability. After the completion of the image formation, the maximum height Rmax on the surface of the photoreceptor as defined in Japanese Industrial Standards (JIS) B0601 was measured using SurfCom 570A manufactured by K.K. Tokyo Seimitsusha. It was evaluated that as the maximum height Rmax after the image formation is smaller, the durability is better.

[Results of Evaluation]

The results of evaluating the cleanability are shown in Table 1. When a phenomenon occurs in which the photoreceptor is actually unusable at each stage (0 k, 25 k, 50 k or 100 k), the number of sheets having images formed at each stage and subjected to the evaluation tests can be said to be the durable number of sheets. Thus, it was shown in terms of the durable number of sheets in the results of evaluation tests shown in Table 1 and tables to be described later.

The photoreceptors in Examples S1 to S7 of which the surface free energy (γ) was within the range of the invention had the evaluation results that the cleanability of all these photoreceptors was good (○) or very good (⊚). Especially, the photoreceptors in Examples S1 to S5 with γ in the range of from 28 to 35 mN/m exhibit the very good (⊚) cleanability.

Meanwhile, the photoreceptor in Comparative Example P4 with γ of less than the range of the invention has a heavy disadvantage due to the decrease in adhesion of the toner or the like to the photoreceptor. The reason is that the decrease in adhesion of the toner or the like to the photoreceptor leads to the increase in transferability, and the residual toner sent to the cleaning blade is reduced. Consequently, inversion of the blade or a blade skip mark occurred on the photoreceptor to invite the decrease in image quality. Further, with the decrease in adhesion, the toner scattering was accelerated, and an adverse effect due to the scattered toner was observed on the front or back of the recording paper. As a result, the black streak or the fog was liable to occur, and the photoreceptor was actually unusable (X) when the number of sheets with images formed was 25 k. Further, in the photoreceptors in Comparative Examples P1 to P3 in which γ was higher than the range of the invention, the toner, the paper powder or the like was adhered to the cleaning blade to damage the surface of the photoreceptor, which led to the decrease in cleanability due to the damage occurring on the surface of the photoreceptor.

TABLE 1

| Photoreceptor | [mN/m] | γ 0k | γ 25k | γ 50k | Durable number of sheets γ 100k |
|---|---|---|---|---|---|
| Ex. | | | | | |
| S6 | 22.00 | ◎ | ○ | ○ | ○ |
| S7 | 25.10 | ◎ | ◎ | ○ | ○ |
| S1 | 28.30 | ◎ | ◎ | ◎ | ◎ |
| S2 | 30.50 | ◎ | ◎ | ◎ | ◎ |
| S3 | 30.50 | ◎ | ◎ | ◎ | ◎ |
| S4 | 33.00 | ◎ | ◎ | ◎ | ◎ |
| S5 | 34.80 | ◎ | ◎ | ◎ | ◎ |
| CEx. | | | | | |
| P4 | 19.80 | Δ | X | X | X |
| P1 | 36.00 | ◎ | ◎ | ○ | Δ |
| P2 | 40.50 | ○ | ○ | X | X |
| P3 | 44.30 | Δ | X | X | X |

The results of evaluating the image stability, namely, the image density decrease level ΔD are shown in Table 2. There was no difference in image density decrease level ΔD between the photoreceptors in Examples S1 to S7 and the photoreceptors in Comparative Examples P1 to P4, and they were all evaluated to be very good (◎: ΔD<5%). Accordingly, no special correlation between the surface free energy (γ) of the photoreceptor and the image density decrease level ΔD was identified.

TABLE 2

| Photoreceptor | [mN/m] | γ 0k | γ 25k | γ 50k | Durable number of sheets γ 100k |
|---|---|---|---|---|---|
| Ex. | | | | | |
| S6 | 22.00 | ◎ | ◎ | ◎ | ◎ |
| S7 | 25.10 | ◎ | ◎ | ◎ | ◎ |
| S1 | 28.30 | ◎ | ◎ | ◎ | ◎ |
| S2 | 30.50 | ◎ | ◎ | ◎ | ◎ |
| S3 | 30.50 | ◎ | ◎ | ◎ | ◎ |
| S4 | 33.00 | ◎ | ◎ | ◎ | ◎ |
| S5 | 34.80 | ◎ | ◎ | ◎ | ◎ |
| CEx. | | | | | |
| P4 | 19.80 | ◎ | ◎ | ◎ | ◎ |
| P1 | 36.00 | ◎ | ◎ | ◎ | ◎ |
| P2 | 40.50 | ◎ | ◎ | ◎ | ◎ |
| P3 | 44.30 | ◎ | ◎ | ◎ | ◎ |

The results of detecting and evaluating the tranquility, namely, the noise are shown in Table 3. In the photoreceptors in Examples S1 to S7 and the photoreceptors in Comparative Examples P1 to P4, occurrence of the "noise" tends to be increased with the increase in surface free energy (γ) to decrease the tranquility. However, upon comparing the photoreceptors in Examples S2 and S3, it was confirmed that although γ showed the same value, occurrence of the "noise" was not detected in the least at any stage of the durable number of sheets in the photoreceptor of Example S3 in which the vibration-proof member was mounted and the effect of the vibration-proof member for the tranquility was excellent.

TABLE 3

| Photoreceptor | [mN/m] | γ 0k | γ 25k | γ 50k | Durable number of sheets γ 100k |
|---|---|---|---|---|---|
| Ex. | | | | | |
| S6 | 22.00 | ◎ | ◎ | ◎ | ◎ |
| S7 | 25.10 | ◎ | ◎ | ○ | ○ |
| S1 | 28.30 | ○ | ○ | Δ | Δ |
| S2 | 30.50 | ○ | Δ | Δ | Δ |
| S3 | 30.50 | ◎ | ◎ | ◎ | ◎ |
| S4 | 33.00 | ○ | Δ | Δ | Δ |
| S5 | 34.80 | ○ | Δ | Δ | Δ |
| CEx. | | | | | |
| P4 | 19.80 | ◎ | ◎ | ◎ | ◎ |
| P1 | 36.00 | Δ | X | X | X |
| P2 | 40.50 | X | X | X | X |
| P3 | 44.30 | X | X | X | X |

Figure 5:
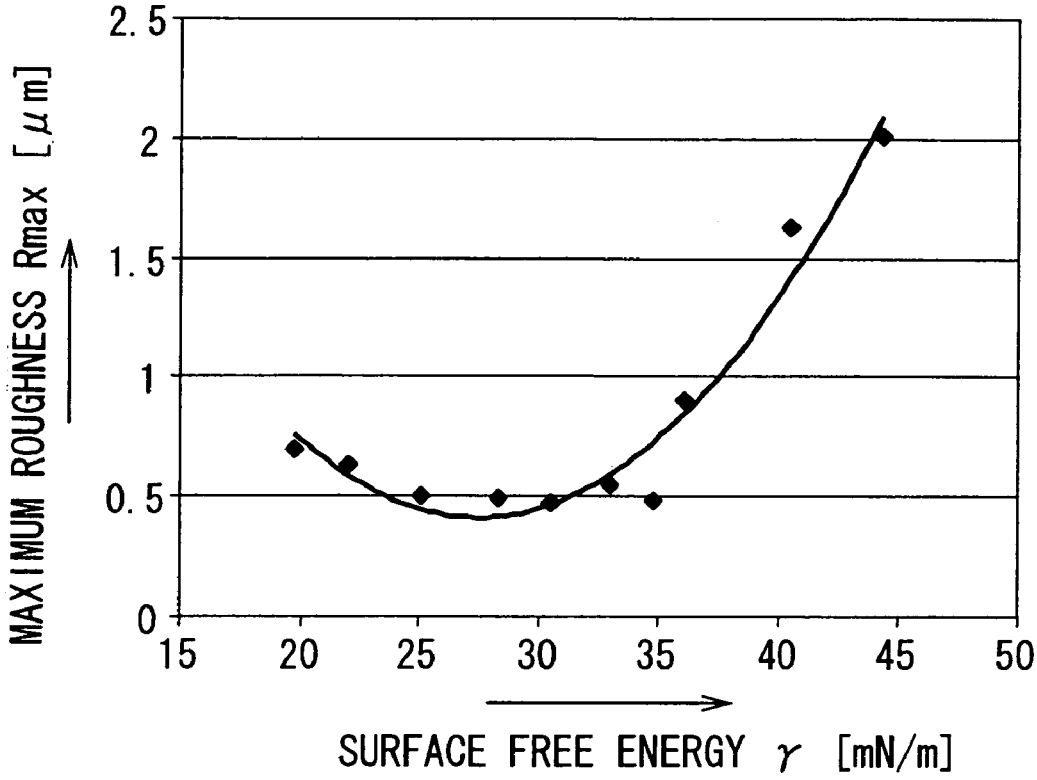
FIG. 5 is a graph showing a relation between a surface free energy (γ) and a maximum height (Rmax) on a surface of a photoreceptor.
Figure 6:
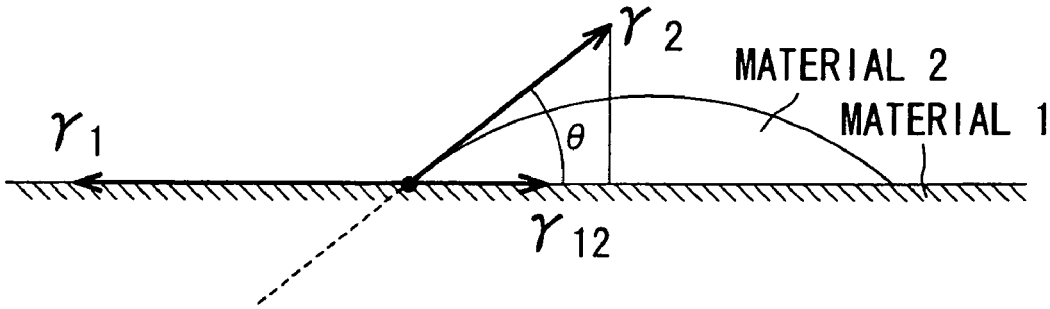
FIG. 6 PRIOR ART
FIG. 6 is a side view showing a condition of adhesion wettability.

The results of measuring the maximum height Rmax on the surfaces of the photoreceptors in Examples and Comparative Examples after completing the image formation of 100 k sheets are shown in Table 4. Further, FIG. 5 is a graph showing a relation between the surface free energy (γ) and Rmax on the surface of the photoreceptor. Table 4 and FIG. 5 reveal that the photoreceptors in Comparative Examples P1 to P3 have the high surface roughness in comparison to the photoreceptors in Examples S1 to S7. In the photoreceptors in Comparative Examples P1 to P3 having the high γ value, there was a great tendency that the surface roughness was increased with the increase in γ. In view of the foregoing, it was confirmed that with the increase in γ, the adhesion of foreign matters to the surface of the photoreceptor was increased and the surface roughness was increased owing to the damage or the like caused by foreign matters adhered.

TABLE 4

| Photoreceptor | γ [mN/m] | Rmax [μm] |
|---|---|---|
| Ex. | | |
| S6 | 22.00 | 0.63 |
| S7 | 25.10 | 0.50 |
| S1 | 28.30 | 0.49 |
| S2 | 30.50 | 0.47 |
| S3 | 30.50 | 0.46 |
| S4 | 33.00 | 0.55 |
| S5 | 34.80 | 0.48 |
| CEx. | | |
| P4 | 19.80 | 0.70 |
| P1 | 36.00 | 0.90 |
| P2 | 40.50 | 1.63 |
| P3 | 44.30 | 2.01 |

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and the range of equivalency of the claims are therefore intended to be embraced therein.

What is claimed is:

1. An electrophotographic photoreceptor comprising:

a conductive substrate; and a photoreceptive layer formed on the conductive substrate, the photoreceptive layer being uniformly charged and being exposed to light corresponding to an image information to form an electrostatic latent image, wherein a surface free energy (γ) on the surface of the photoreceptive layer is at least 20 mN/m and at most 35 mN/m, and wherein the photoreceptive layer is an outermost layer of the electrophotographic photoreceptor.

2. The electrophotographic photoreceptor of claim 1, wherein the surface free energy (γ) is at least 28 mN/m and at most 35 mN/m.

3. The electrophotographic photoreceptor of claim 1, wherein the photoreceptive layer is formed by laminating a charge generating layer containing a charge generating material and a charge transporting layer containing a charge transporting material.

4. The electrophotographic photoreceptor of claim 1, wherein the photoreceptive layer is a single layer structure containing a charge generating material and a charge transporting material.

5. The electrophotographic photoreceptor of claim 1, wherein a vibration-proof member is mounted inside the conductive substrate.

6. An image forming apparatus comprising:

an electrophotographic photoreceptor including a conductive substrate and a photoreceptive layer formed on the conductive substrate, the photoreceptive layer being uniformly charged and being exposed to light corresponding to an image information to form an electrostatic latent image, wherein a surface free energy (γ) on the surface of the photoreceptive layer is at least 20 mN/m and at most 35 mN/m, and wherein the photoreceptive layer is an outermost layer of the electrophotographic photoreceptor.

7. An electrophotographic photoreceptor comprising:

a conductive substrate; and a photoreceptive layer formed on the conductive substrate, the photoreceptive layer being uniformly charged and being exposed to light corresponding to an image information to form an electrostatic latent image, wherein a surface free energy (γ) on the surface of the photoreceptive layer is at least 20 mN/m and at most 35 mN/m, and wherein the photoreceptor layer is formed of an organic material.

8. The electrophotographic photoreceptor of claim 7, wherein the surface free energy (γ) is at least 28 mN/m and at most 35 mN/m.

9. The electrophotographic photoreceptor of claim 7, wherein the photoreceptive layer is formed by laminating a charge generating layer containing a charge generating material and a charge transporting layer containing a charge transporting material.

10. The electrophotographic photoreceptor of claim 7, wherein the photoreceptive layer is a single layer structure containing a charge generating material and a charge transporting material.

11. The electrophotographic photoreceptor of claim 7, wherein a vibration-proof member is mounted inside the conductive substrate.

12. An image forming apparatus comprising:

an electrophotographic photoreceptor including a conductive substrate and a photoreceptive layer formed on the conductive substrate, the photoreceptive layer being uniformly charged and being exposed to light corresponding to an image information to form an electrostatic latent image, wherein a surface free energy (γ) on the surface of the photoreceptive layer is at least 20 mN/m and at most 35 mN/m, and wherein the photoreceptive layer is formed of an organic material.

* * * * *